United States Patent [19]

Johnson

[11] Patent Number: 5,005,652

[45] Date of Patent: Apr. 9, 1991

[54] METHOD OF PRODUCING A CONTOURED WORK SURFACE

[75] Inventor: David M. Johnson, Matlock, England

[73] Assignee: John Kelly (Lasers) Limited, Barlow, England

[21] Appl. No.: 479,934

[22] Filed: Feb. 14, 1990

[30] Foreign Application Priority Data

Feb. 24, 1989 [GB] United Kingdom ..... 8904211

[51] Int. Cl.[5] ..... E02F 1/00/3/85

[52] U.S. Cl. ..... 172/1; 172/4.5; 172/2; 37/DIG. 1; 364/424.07

[58] Field of Search ..... 172/2, 4.5; 37/DIG. 1, 37/DIG. 20; 364/424.01, 424.07; 104/2, 7.1, 7.2, 7.3

[56] References Cited

U.S. PATENT DOCUMENTS 3,953,145 4/1976 Teach ..... 172/4.5 X
4,162,708 7/1979 Johnson ..... 37/DIG. 20 X
4,374,420 2/1983 Wolters ..... 364/424.07
4,452,146 6/1984 Bradshaw et al. ..... 104/7.1
4,655,142 4/1987 Theurer et al. ..... 104/7.1
4,807,131 2/1989 Clegg ..... 37/DIG. 20 X

FOREIGN PATENT DOCUMENTS 1180440 9/1985 U.S.S.R. ..... 104/7.2

*Primary Examiner*—Randolph A. Reese
*Assistant Examiner*—Jeffrey L. Thompson
*Attorney, Agent, or Firm*—Abelman Frayne Rezac & Schwab

[57] ABSTRACT

A method of producing a work surface by producing a reference plane 2—2 and traversing a working tool 104 in a direction generally parallel to said reference plane. So that the required work surface can be a surface other than of flat planar form, the distance of the working tool 104 from the reference plane 2—2 is varied in accordance with instructions from a computer 120 in response to a measure of distance travelled.

3 Claims, 3 Drawing Sheets

METHOD OF PRODUCING A CONTOURED WORK SURFACE

FIELD OF THE INVENTION.

The invention relates to control apparatus whereby a working tool forming part of earth moving machinery, road maintenance and renewal plant or railway maintenance and renewal equipment may be controlled in order to produce a required surface contour.

It has been known for some time to use a laser beam to scan a flat plane and thereby produce a reference plane from which a working tool such as a bulldozer blade can be maintained at a fixed spacing in order to produce a flat planar work surface. However, the equipment previously available has not been capable of producing a work surface other than of flat planar form. The invention has for its object to at least alleviate this disadvantage.

SUMMARY OF THE INVENTION.

According to one aspect of the invention, there is provided a travelling machine for working a surface over which the machine travels, the machine having a surface working tool raisable and lowerable relative to the machine and said surface, radiation receiving means associated with and raisable and lowerable relative to the tool, and control means operative to control raising and lowering of the tool so that the receiving means tracks a preset radiation beam and further operative to control raising and lowering of the receiving means relative to the tool so that the tool follows a desired contouring of said surface. The control means may include distance of travel measuring means, storage and retrieval means for data defining said contouring relative to measurement of distance and to said reference beam. Storage and retrieval means may comprise programmed computer means operative relative to stored data and signals from distance measuring means. The distance measuring means will preferably include a distance wheel rotatable by contact with the surface over which the machine travels.

According to another aspect of the invention, a method of producing a work surface of other than flat planar form includes the steps of producing a reference plane by means of a radiation beam and traversing a working tool in a direction generally parallel to said reference plane whilst varying the distance of said working tool from said reference plane in accordance with instructions from a computer in response to a measure of distance travelled by the working tool in the direction generally parallel to the reference plane.

BRIEF DESCRIPTION OF THE DRAWINGS.

FIG. 3 is a block circuit diagram which will b referred to.

DESCRIPTION OF THE PREFERRED EMBODIMENT.

Figure 1:
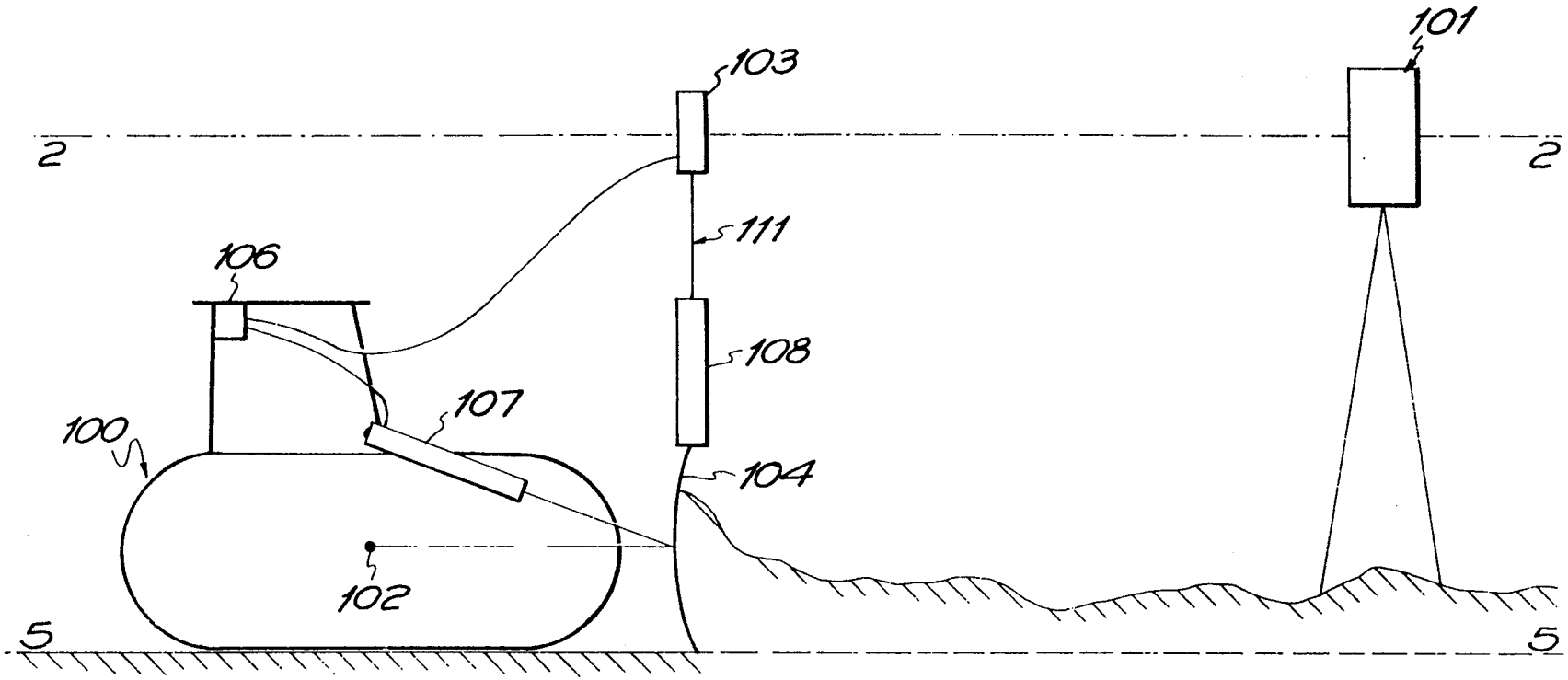
FIG.1 PRIOR ART
FIG. 1 is a diagrammatic illustration of a prior art control apparatus of conventional type fitted to an item of earth moving machinery.

Referring now to FIG. 1, the item of earth moving machinery there illustrated is a tracklaying vehicle generally indicated 100 carrying a working tool in the form of a bulldozer blade 104 The bulldozer blade is pivotally connected for vertical adjustments relative to the vehicle about a pivotal connection 102. The blade 104 can be raised or lowered by means of a pair of hydraulic rams 107 which flank the vehicle. The hydraulic rams 107 are under the control of a control system 106 carried on the vehicle.

As shown, the blade 104 carries an upwardly extending mast generally indicated 111, a lower part of which is constituted by an electric actuator 108. At its upper end the mast carries a laser beam detector 103 for signals emitted by a laser 101 and forming a reference plane 2-2 (which may be horizontal or otherwise).

In use of the apparatus thus far described and with the actuator 108 at a fixed setting, the tracklaying vehicle can be driven forwards, as shown, whilst the signal from the laser is received by the detector 103. Continuously throughout the operation of the equipment the detector determines whether the locus of the detector, the blade 104 and hence the profile of the work surface 5—5 being produced are deviating from the required datum Upon the detection of any deviation, the control system 106 provides hydraulic control of the hydraulic rams 107 such that the detector, blade and hence the cut surface are returned to the correct elevation parallel to the reference plane 2—2. Consequently, the apparatus can produce a planar surface, parallel to the reference plane 2—2, which will be very accurate indeed. If the actuator 108 is extended, the operation can be repeated to reduce the height of the work surface by that same distance but the finished surface will again be a planar surface parallel to the reference plane 2—2.

Figure 2:
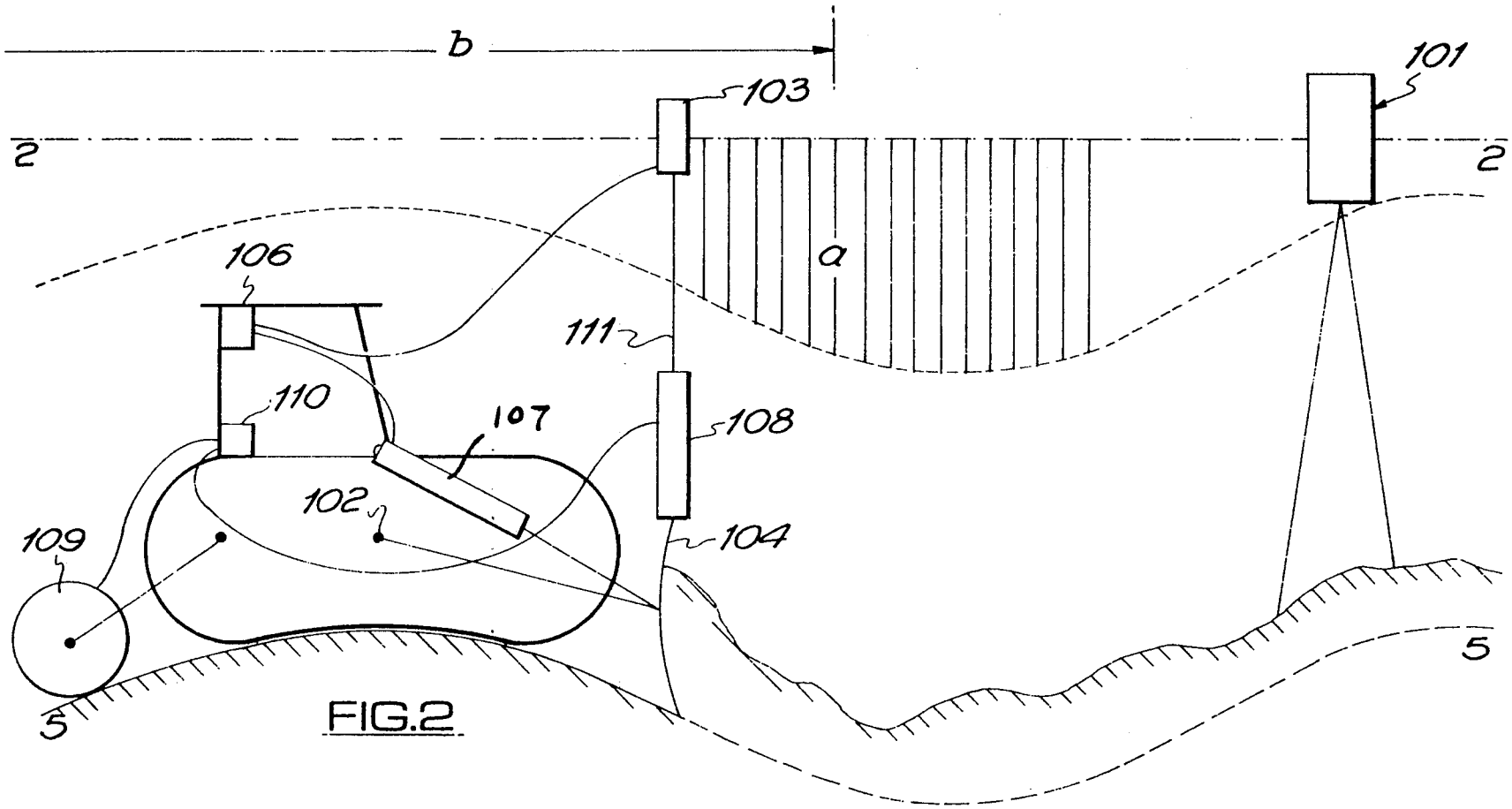
FIG. 2 is an illustration similar to FIG. 1 but showing the apparatus modified in a manner embodying the invention and in use for moving a working tool along a required path which departs from a flat plane.
Figure 3:
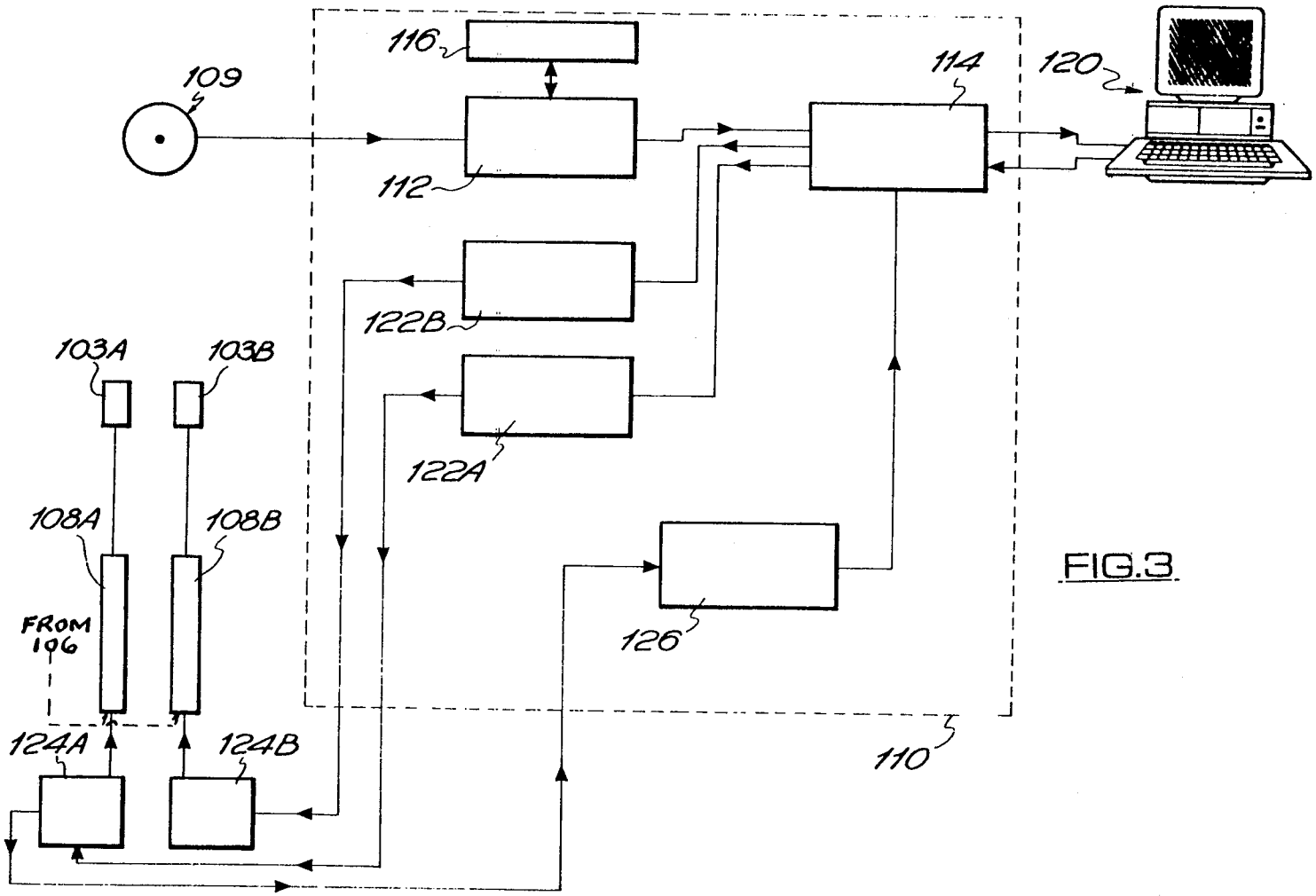

Referring now to FIGS. 2 and 3, these illustrate the way in which the control apparatus has been modified and in FIG. 2 is shown in use for traversing the blade 104 along a required path which departs from a flat plane. As shown, a distance wheel 109 has been mounted o the tracked vehicle to give a distance measurement from a starting point. The distance wheel is rotatable without any appreciable slippage by contact with the ground surface being worked. The actuators 108A and 108 B which determine the effective heights of the masts 111A and 111B, one for each side of the bulldozer blade in order to ensure it is kept level and/or that a worked surface is produced with a gradient transverse to the direction of travel of the machine 100, are under the control of a control unit 110.

Referring now in particular to FIG. 3, which is a block circuit diagram for mast control, the two laser beam detectors 103A,B and related actuators 108A,B are shown in association with the control unit 110. The mast control unit 110 comprises a microprocessor 112 and a parallel-to-serial RS232 interface 114. The microprocessor 112 serves to hold data concerning the distance travelled. A portable computer 120 is shown which accepts such data through the interface 114. The computer 120 is responsive to travelled distance data shown as an input from the measuring wheel 109 for producing the mast extension data in orderly manner.

The mast extension data goes via the interface 114 to basic mast drive control circuits 122A,B that hold data words, for example as decremented counters that provide pulses for mast control drives 124A,B of stepping motor type.

In another mode of operation, signals from the blade control system 106 otherwise used for controlling the hydraulic rams to keep the laser detectors 103 on the reference 2—2 are used directly for mast height control purposes, see dashed. Then, signals from one of the mast control drives (124A) are fed to a decoder unit 126 controlled by the computer 120 to generate corresponding terrain contour data words via the interface 114.

The arrangement is such that, in order to produce a particular form of work surface 5—5, that is to say of other than flat planar form, the bulldozer blade can be traversed in a direction generally parallel to the reference plane 2—2 whilst varying the distance of the blade from said reference plane in accordance with instructions from the computer, forming part of the control unit 110, which contains the pre-programmed instructions. The preprogrammed instructions are issued by the computer in accordance with the distance measurement transmitted to it by the distance wheel 109. In other words, and as indicated diagrammatically in FIG. 2, required incremental adjustments in the effective lengths of the masts 111A and 111B, these being indicated notionally as a varying dimension a from the reference plane 2—2, are issued by the computer in accordance with the distance b from a starting point. In effect, as the blade is raised and lowered so that the laser beam detectors follow the reference beam, the receivers are simultaneously raised and lowered relative to the blade so that the blade follows the desired contouring of the surface. The control system 106, in combination with the hydraulic rams 107 and the control unit 110, constitutes control means whereby this is brought about.

It will be understood that whereas it has previously been possible by means of the control apparatus illustrated in FIG. 1 to produce a work surface of flat planar form to within very close limits, it is now possible, by control apparatus embodying the invention, to produce a particular surface of other than flat planar form to equally close limits. Also it is possible for the computer to be provided electronically with measurements of the mast extensions required to keep the laser beam detectors 103A and 103B in the plane 2—2 as the vehicle 100 is driven along a surface, these readings subsequently being analysed with respect to the distance travelled to produce a complete longitudinal survey section. However, various modifications may be made. For example, provision may be made for the computer to calculate a measured laser gradient based upon elevation readings entered on site.

The extension of the masts 111A and 111B could be controlled by the output signals derived from the laser beam detectors. In this mode, the elevation of the laser beam detectors would be maintained on a constant plane whatever the elevation of the device to which the masts were attached. Thus the extension of the masts would be directly proportional to the elevation of the ground relative to the gradient of the laser beam. Where this was set to horizontal, the extension of the masts would relate directly to the absolute elevation of the ground surface.

The distance measurement transmitted to the computer need not necessarily be produced by a distance wheel 109. Any other means for producing a distance measurement from a starting point could be employed (but measuring the movement of the tracks of a track laying vehicle would probably no be satisfactory because any slippage of the tracks would introduce a false reading).

What is claimed and desire to secure by Letters Patent is:

1. A method of producing a desired contouring of other than flat planar form of a work surface, that includes the steps of producing a reference plane by means of a radiation beam, and traversing the terrain by a machine supporting a working tool and carrying radiation receiving means on raisable and lowerable masts so that said receiving means are maintained in said reference plane, the extension of said masts being directly proportional to the elevation of the ground relative to the gradient of the radiation beam, further including the steps of using storage and retrieval means comprising a programmed computer for data defining the desired non-planar contouring of the terrain and varying the distance of said working tool from the reference plane in accordance with instructions from the computer in response to a measure of distance travelled by the working tool in the direction generally parallel to the reference plane.

2. A method according to claim 1 of producing a desired contouring of a work surface, in which the step of measuring distance travelled by the working tool is performed by a distance wheel mounted on the machine, the distance wheel being rotatable without any appreciable slippage by contact with the surface being worked.

3. The method of claim 1, in which said radiation beam and said radiation receiving means are respectively, a laser generator and receiver.

* * * * *